US006086465A

United States Patent [19]

Mayr

[11] Patent Number: 6,086,465

[45] Date of Patent: Jul. 11, 2000

[54] DEVICE FOR POST-MACHINING A STEEL EDGE OF A SKI

[75] Inventor: Reinhold Mayr, Waldzell, Austria

[73] Assignee: Wintersteiger GmbH, Ried, Austria

[21] Appl. No.: 09/230,307

[22] PCT Filed: Jul. 22, 1997

[86] PCT No.: PCT/AT97/00170

§ 371 Date: Jan. 22, 1999

§ 102(e) Date: Jan. 22, 1999

[87] PCT Pub. No.: WO98/04384

PCT Pub. Date: Feb. 5, 1998

[30] Foreign Application Priority Data

Jul. 25, 1996 [AT] Austria ..... 1339/96

[51] Int. Cl.[7] ..... B21K 17/00

[52] U.S. Cl. ..... 451/293; 451/260; 451/280; 76/83

[58] Field of Search ..... 451/260, 282, 451/293, 280; 76/83

[56] References Cited

U.S. PATENT DOCUMENTS

| | | | |
|---|---|---|---|
| 4,094,101 | 6/1978 | Robinson | 51/5 D |
| 4,679,356 | 7/1987 | Thomas | 51/205 WG |
| 4,818,839 | 4/1989 | Chastain | 219/76.14 |
| 5,136,816 | 8/1992 | Beckingham | 51/128 |
| 5,597,344 | 1/1997 | Bocquet | 451/65 |

FOREIGN PATENT DOCUMENTS

| | | |
|---|---|---|
| 348 390 | 6/1978 | Austria . |
| 0 058 983 | 9/1982 | European Pat. Off. . |
| 38 27 977 | 4/1989 | Germany . |
| 39 14 977 | 11/1990 | Germany . |
| 661 876 | 8/1997 | Switzerland . |
| 623 716 | 8/1978 | U.S.S.R. . |
| 90/13395 | 11/1990 | WIPO . |

*Primary Examiner*—William Hong
*Attorney, Agent, or Firm*—Collard & Roe, P.C.

[57] ABSTRACT

There is described an apparatus for finishing a steel edge (14) of a ski (15) by means of a pot-shaped grinding wheel (1) driven by a motor (2) with an axis of rotation extending transverse to the feed direction (8). To create advantageous constructional conditions it is proposed that the grinding wheel (1) with the motor (2) should be mounted in a frame (7) of a setting means so as to be freely rotatable about a swing axis (a) limited by a stop, which swing axis extends transverse to the feed direction (8) and vertical to the axis of rotation of the grinding wheel (1), and that for setting the grinding wheel (1) against the steel edge (14) the setting means can be swivelled in the direction of the axis of rotation of the grinding wheel (1) about a swivel axis (b) parallel to the feed direction (8) between two working positions on the one hand for the machining surface of the steel edge (14) on the side of the running surface and on the other hand for the outer machining surface of the steel edge (14).

6 Claims, 4 Drawing Sheets

DEVICE FOR POST-MACHINING A STEEL EDGE OF A SKI

FIELD OF THE INVENTION

This invention relates to an apparatus for finishing a steel edge of a ski, consisting of a pot-shaped grinding wheel driven by a motor with an axis of rotation extending transverse to the feed direction.

BACKGROUND OF THE INVENTION

For finishing worn steel edges of a ski it is known (DE 39 14 977 A1) to use a pot-shaped grinding wheel driven by a motor with an axis of rotation inclined under an acute angle with respect to the feed direction and to the running surface of the ski, so that the ring-shaped end face of the grinding wheel rests against the outer machining surface of the steel edge merely in a peripheral portion. With such a setting of the grinding wheel there can be achieved a feed following the course of the side face of the steel edges waisted in longitudinal direction, but the grinding results remain unsatisfactory, because due to the waisted course of the steel edge the set angle changes over the length of the steel edge. Moreover, with such an apparatus merely the side faces of the steel edges, but not their machining surfaces on the side of the running surface can be ground.

BRIEF SUMMARY OF THE INVENTION

It is therefore the object underlying the invention to provide an apparatus for finishing a steel edge of a ski as described above such that a simple and precise grinding of the steel edge becomes possible not only at the outer machining surface, but also at the machining surface on the side of the running surface.

This object is solved by the invention in that the grinding wheel together with the motor is mounted in a frame of a setting means so as to be freely rotatable about a swing axis limited by a stop, which swing axis extends transverse to the feed direction and vertical to the axis of rotation of the grinding wheel, and that for setting the grinding wheel against the steel edge the setting means can be swivelled in the direction of the axis of rotation of the grinding wheel about a swivel axis parallel to the feed direction between two working positions on the one hand for the machining surface of the steel edge on the side of the running surface and on the other hand for the outer machining surface of the steel edge.

Since the grinding wheel is freely rotatable about a swing axis, which extends vertical to the axis of rotation of the grinding wheel and preferably likewise vertical to the feed direction, the grinding wheel can be set against the steel edge in a self-aligning way by means of the setting means such that it abuts in two peripheral portions disposed opposite each other with respect to a chord, which provides for an independent adaptation of the alignment of the grinding wheel with respect to the respective machining surface of the steel edge even in the waisted portion of the longitudinal side. The optional machining either of the machining surface of the steel edge on the side of the running surface or of the outer machining surface of the steel edge is effected by a swivel movement of the setting means, so that the axis of rotation of the grinding wheel is vertically aligned with respect to the respective machining surface. By correspondingly activating the setting means, for instance by means of an actuating cylinder, the grinding wheel can be set against the steel edge after the swivel movement, so as to independently follow the longitudinal course of the steel edge during the machining feed, which in particular in the waisted portion of the ski requires a corresponding readjustment via the setting means.

The setting means may be designed in various constructions, because it is merely important that the grinding wheel is properly set against the surface of the steel edge to be machined in direction of its axis of rotation. For this purpose, the setting means may consist of a carriage which can be moved on a sliding guideway parallel to the axis of rotation of the grinding wheel. In this case, the sliding guideway includes the swivel axis for the two working positions, so that the carriage is swivelled together with its sliding guideway, so that after machining the one surface of the steel edge the other surface to be machined can be ground. Another possibility for the design of the setting means is obtained when the setting means forms a carrier to be swivelled about the swivel axis, on which carrier the frame for the pendular support of the grinding wheel is pivotally mounted via a hinged parallelogram. By means of this hinged parallelogram the grinding wheel can be set against the respective surface of the steel edge to be machined in the direction of the grinding wheel axis.

To ensure a rather low-friction pendulum movement for the grinding wheel, a holder mounted in the frame of the carriage between pivot points as swing axis may be provided for the grinding wheel together with the motor.

Since the swivel angle between the two working positions of the setting means determines the angle between the two machining surfaces of the steel edge, the angles of inclination of these machining surfaces can also be predetermined by means of stops for these working positions. For this purpose, there may be provided adjustable stops for the setting means. Particularly simply constructional conditions can be achieved in this connection in that the stops for the setting means consist of rotatable stop cams. To determine the desired inclination of the machining surfaces, the stop cams must merely be rotated in this case in the corresponding stop position, so as to ensure usually predetermined angles of inclination for the machining surfaces.

BRIEF DESCRIPTION OF THE DRAWINGS

In the drawing, the subject-matter of the invention is represented by way of example, wherein.

DETAILED DESCRIPTION OF THE INVENTION

Figure 1:
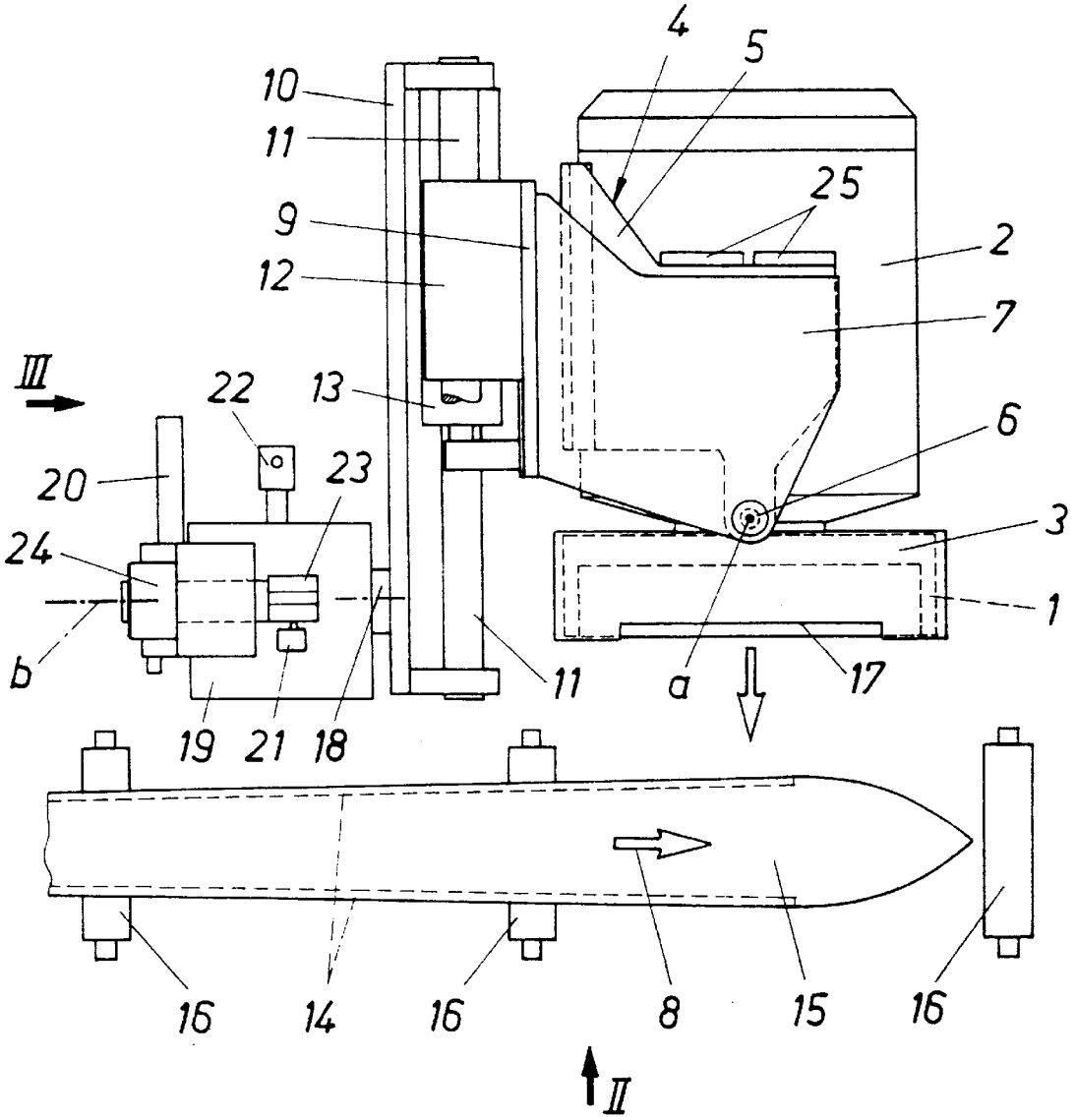
FIG. 1 shows an inventive apparatus for finishing a steel edge of a ski in a simplified top view.

The represented apparatus comprises a pot-shaped grinding wheel 1, which is flange-mounted to the drive shaft of a motor 2 and is provided with a protective cover 3. This constructional unit formed of the motor 2 and the grinding wheel 1 is mounted on a substantially U-shaped holder 4, whose legs 5 are held so as to be freely rotatable between pivot points 6 of a frame 7 encompassing the holder 4. These pivot points 6 thus form a swing axis a for the grinding wheel 1, which swing axis extends vertical to the axis of rotation of the grinding wheel 1 and to the feed direction 8, as can be taken in particular from FIGS. 1 and 2.

The frame 7 is part of a setting means, which in accordance with FIGS. 1 to 4 is formed by a carriage 9, which can be moved on a sliding guideway 10 in the direction of the axis of rotation of the grinding wheel 1. For this purpose, the sliding guideway 10 has two parallel guiding rods 11, on which the carriage 9 is movably mounted by means of sliding blocks 12. The drive for moving the carriage consists of an actuating cylinder 13 to be charged for instance with compressed air. By means of this actuating cylinder 13, the grinding wheel 1 can accordingly be set against the steel edge 14 of a ski 15, which on supporting rollers 16 is moved past the grinding wheel 1 in feed direction 8. The protective cover 3 has a recess 17 in the machining portion, as can be taken in particular from FIG. 1. Due to the pendular support about the swing axis a formed by the pivot points 6, the grinding wheel 1 will align itself with respect to the steel edge 14 to be machined in the case of an axial load, so that despite the waisted shape of the ski 15 an exact machining of the longitudinal side of the steel edge 14 is achieved. The pressure exerted on the grinding wheel 1 by the actuating cylinder 13 in addition ensures a readjustment of the carriage 9 corresponding to the changes in width of the ski 15.

Figure 2:
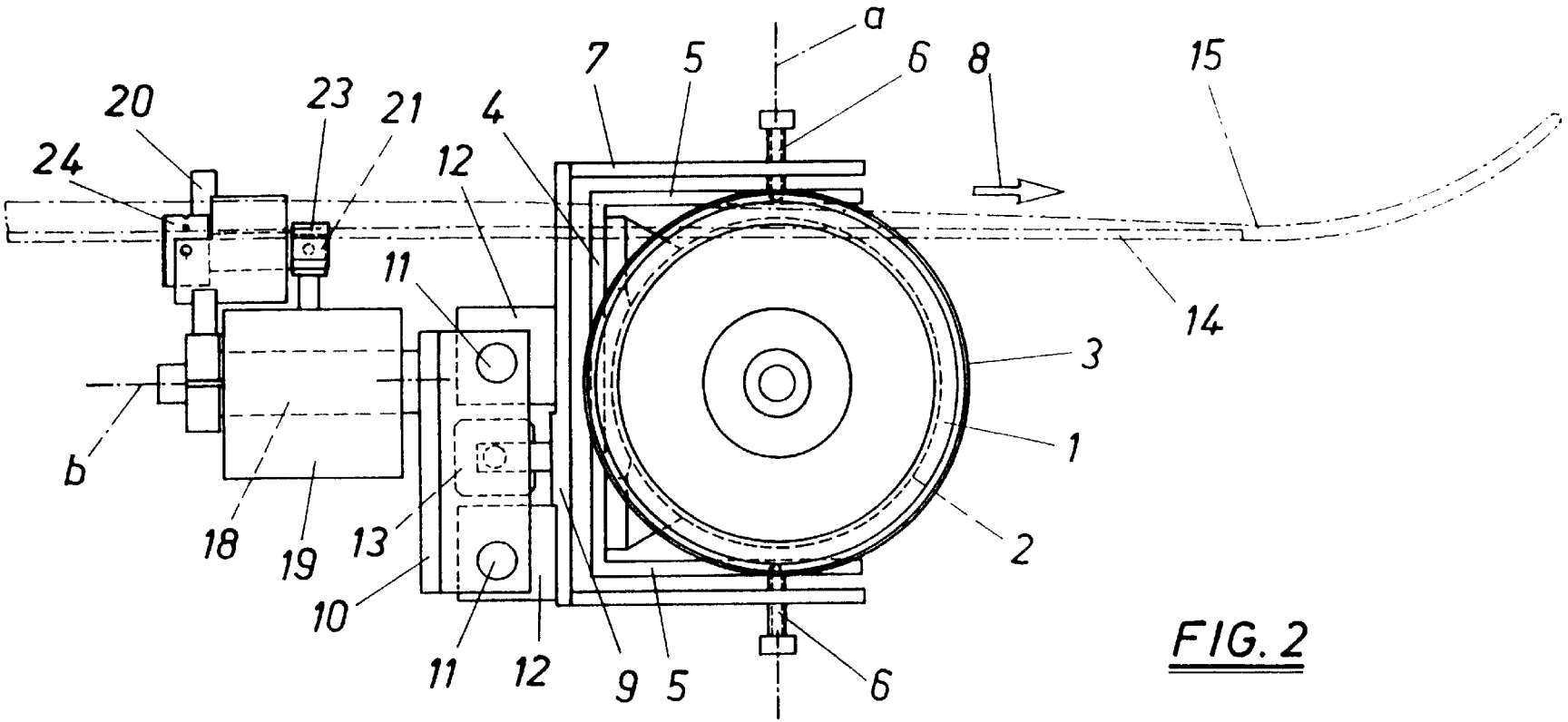
FIG. 2 shows this apparatus in a side view in direction 11 of FIG. 1.
Figure 3:
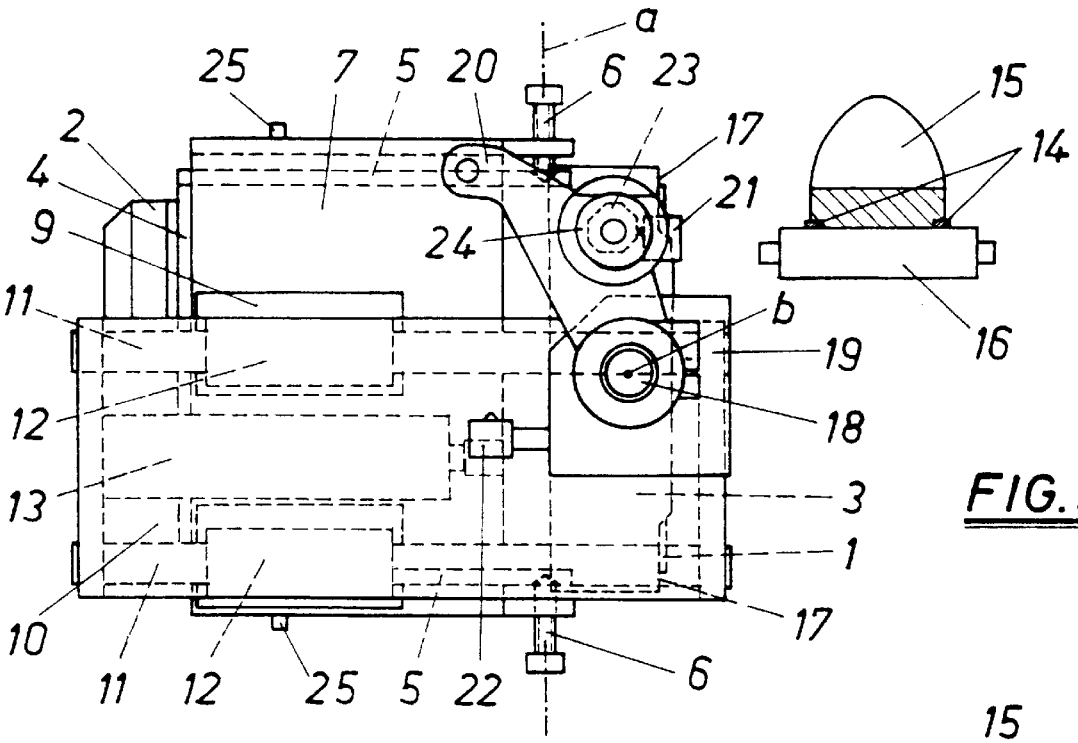
FIG. 3 shows a view in direction III of FIG. 1.

For regrinding not only the longitudinal side of the steel edge 14, but also the machining surface of the steel edge 14 on the side of the running surface, the sliding guideway 10 is disposed on a shaft 18 extending parallel to the feed direction 8, whose bearing is designated with 19. On this shaft 18 an actuating arm 20 is seated, by means of which the sliding guideway 10 can be swivelled between two working positions, which are defined by stops 21 and 22 in cooperation with a counterstop 23. Since the counterstop 23 constitutes a rotatable stop cam, both the outer machining surfaces and the machining surfaces on the side of the running surface can easily be machined according to predetermined angles of inclination. For rotating such counterstop 23, a corresponding adjusting knob 24 may be provided. FIGS. 1 to 3 illustrate the working position for grinding the longitudinal side of the steel edge 14. In this working position, the counterstop 23 cooperates with the stop 21.

Figure 4:
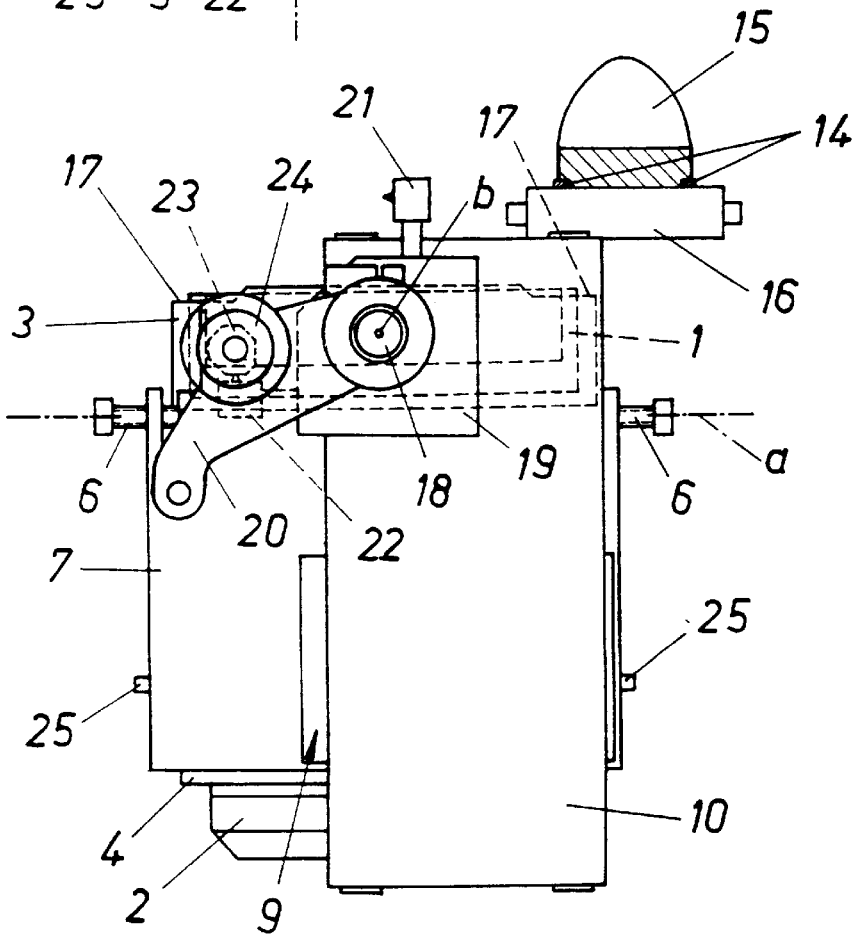
FIG. 4 shows a representation of the apparatus corresponding to FIG. 3 in a working position swivelled with respect to FIGS. 1 to 3.

For machining the side of the running surface of the steel edge 14, the sliding guideway 10 is swivelled by means of the actuating arm 20 about the shaft 18 into the working position shown in FIG. 4, in which the stop 22 is involved. Accordingly, the grinding wheel 1 is moved between its two working positions about a swivel axis b formed by the shaft 18 and parallel to the feed direction 8. By operating the actuating cylinder 13, the grinding wheel 1 is set independent of the respective working position. However, as compared to a machining of the longitudinal side of the steel edge, the grinding wheel 1 abuts against the steel edge 14 in an opposite peripheral portion, which requires a formation of the protective cover 3 with two recesses 17 disposed opposite each other. In both working positions, the steel edge 14 forms a chord with respect to the ring-shaped end face of the pot-shaped grinding wheel 1, so that by abutting the grinding wheel 1 against two peripheral portions disposed opposite each other with respect to this chord a precise guidance of the grinding wheel with respect to the steel edge 14 is ensured due to the pendular support of the grinding wheel, which represents a major condition for an exact finishing of the steel edge 14.

To limit the pendulum movement of the constructional unit formed of grinding wheel 1 and motor 2 to the required extent, corresponding stops 25 may be provided, which in accordance with the embodiment constitute angular projections on one of the legs 5 of the holder 4 and cooperate with the frame 7. These stops are particularly important when at the beginning or at the end of the grinding operation the grinding wheel 7 rests against the steel edge 14 in only one of the two peripheral portions, because the rear peripheral portion in feed direction has not yet reached the machining surface or the front peripheral portion has already left the machining surface.

Figure 5:
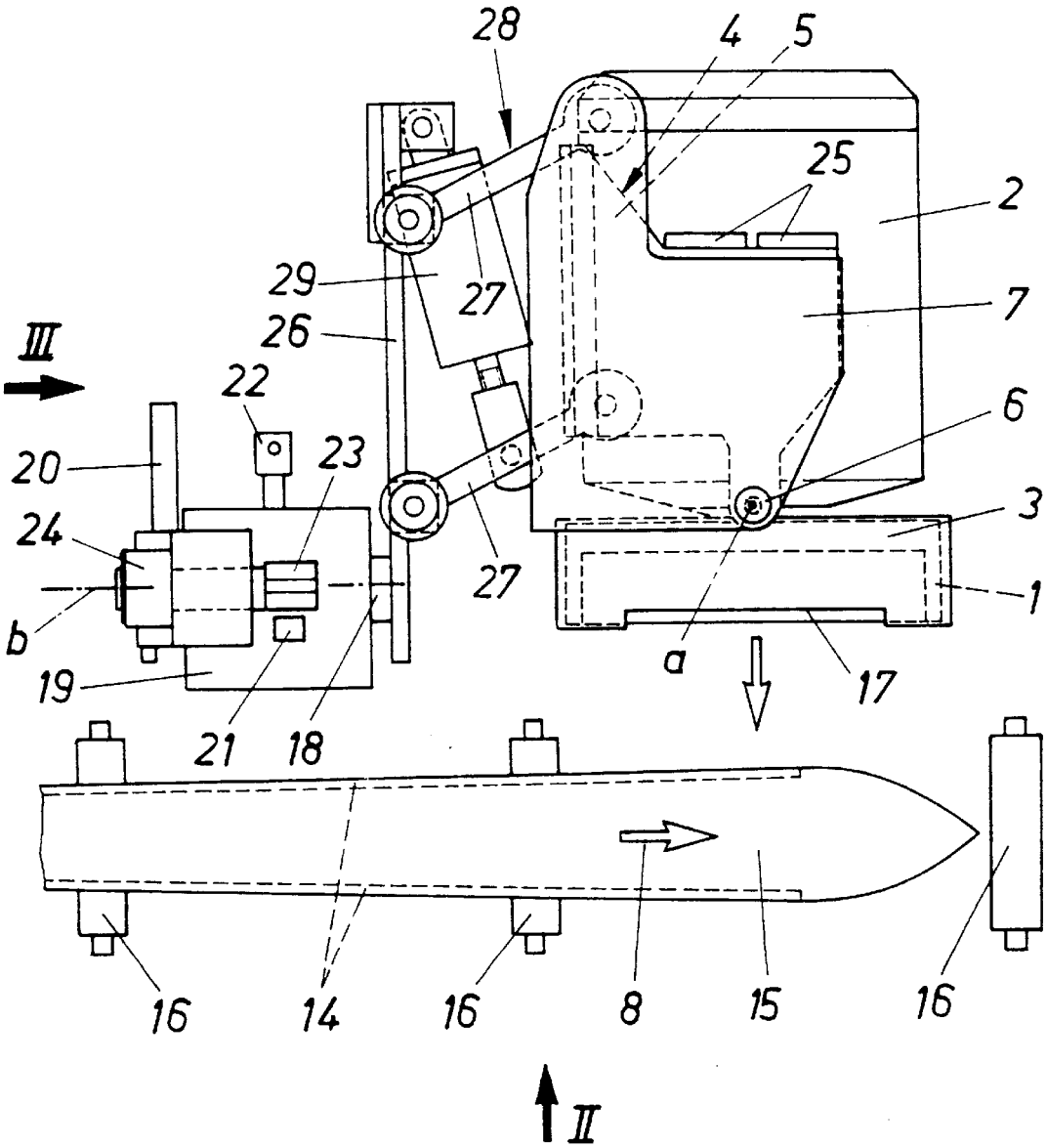
FIG. 5 shows a representation of a constructional variant of the inventive apparatus corresponding to FIG. 1.

The apparatus shown in FIG. 5 comprises a setting means for the grinding wheel which is modified as compared to the embodiment shown in FIGS. 1 to 4. The setting means shown in FIG. 5 consists of a carrier 26 mounted on the shaft 18, which carrier is connected with the frame 7 by guiding cheeks 27 pivotally mounted both at the carrier 26 and at the frame 7. These guiding cheeks 27 form a hinged parallelogram 28 for setting the grinding wheel 1 in the direction of its axis of rotation. The setting movement is performed by means of an actuating cylinder 29, which is charged for instance with compressed air. By swivelling the carrier 26 about the swivel axis b, machining the steel edge 14 becomes analogously possible in the vicinity of two machining surfaces.

What is claimed is:

1. An apparatus for finishing a steel edge (14) of a ski (15), consisting of a pot-shaped grinding wheel (1) driven by a motor (2) with an axis of rotation extending transverse to the feed direction (8), characterized in that the grinding wheel (1) with the motor (2) is mounted in a frame (7) of a setting means so as to be freely rotatable about a swing axis (a) limited by a stop, which swing axis extends transverse to the feed direction (8) and vertical to the axis of rotation of the grinding wheel (1), and that for setting the grinding wheel (1) against the steel edge (14) the setting means can be swivelled in the direction of the axis of rotation of the grinding wheel (1) about a swivel axis (b) parallel to the feed direction (8) between two working positions on the one hand for the machining surface of the steel edge (14) on the side of the running surface and on the other hand for the outer machining surface of the steel edge (14).

2. The apparatus as claimed in claim 1, characterized in that the setting means consists of a carriage (9), which can be moved on a sliding guideway (10) parallel to the axis of rotation of the grinding wheel (1), which sliding guideway includes the swivel axis (b) for swivelling the carriage (1) between the two working positions for machining the steel edge (14).

3. The apparatus as claimed in claim 1, characterized in that the setting means forms a carrier (26) to be swivelled about the swivel axis (b), on which carrier the frame (7) for the pendulum support of the grinding wheel (1) is pivotally mounted via a hinged parallelogram (28).

4. The apparatus as claimed in claim 1, characterized in that for the grinding wheel (1) with the motor (2) there is provided a holder (4) mounted in the frame (7) of the setting means between pivot points (6) as swing axis (a).

5. The apparatus as claimed in claim 1, characterized in that the two working positions of the setting means can be adjusted by means of adjustable stops (21, 22) or at least one adjustable counterstop (23).

6. The apparatus as claimed in claim 5, characterized in that the stops (21, 22) or their counterstop (23) consist of rotatable stop cams.

* * * * *